US012523392B2

(12) United States Patent
Khader

(10) Patent No.: US 12,523,392 B2
(45) Date of Patent: Jan. 13, 2026

(54) AIR HANDLING UNIT CONSTRUCTION

(71) Applicant: Innovative Climatic Technologies Corporation, Phoenix, AZ (US)

(72) Inventor: Ahmed Hussain Khader, Sugar Land, TX (US)

(73) Assignee: Innovative Climatic Technologies Corporation, Phoenix, AZ (US)

( * ) Notice: Subject to any disclaimer, the term of this patent is extended or adjusted under 35 U.S.C. 154(b) by 138 days.

(21) Appl. No.: 18/595,322

(22) Filed: Mar. 4, 2024

(65) Prior Publication Data

US 2025/0277600 A1 Sep. 4, 2025

(51) Int. Cl.
*F24F 13/20* (2006.01)
*F24F 3/044* (2006.01)

(52) U.S. Cl.
CPC ..... *F24F 13/20* (2013.01); *F24F 3/044* (2013.01)

(58) Field of Classification Search
CPC ..... F24F 13/20; F24F 3/044
USPC ..... 165/47
See application file for complete search history.

(56) References Cited

U.S. PATENT DOCUMENTS

| | | | | |
|---|---|---|---|---|
| 5,870,868 | A | 2/1999 | Kita et al. | |
| 9,964,330 | B2 | 5/2018 | Son et al. | |
| 10,316,516 | B2 | 6/2019 | Carlyon | |
| 10,443,884 | B2 | 10/2019 | Buswell | |
| 10,443,885 | B2 | 10/2019 | Son et al. | |
| 10,925,185 | B1 * | 2/2021 | Bailey | H05K 7/20736 |
| 2004/0063398 | A1 | 4/2004 | Beser et al. | |
| 2007/0204752 | A1 | 9/2007 | Hord et al. | |
| 2015/0111485 | A1 | 4/2015 | Son et al. | |
| 2020/0284447 | A1 * | 9/2020 | Brubaker | F24F 13/20 |
| 2021/0239358 | A1 * | 8/2021 | Griesinger | F24F 13/20 |
| 2021/0325082 | A1 | 10/2021 | Chothave et al. | |

* cited by examiner

*Primary Examiner* — Steve S Tanenbaum
(74) *Attorney, Agent, or Firm* — Thomas W. Galvani, P.C.; Thomas W. Galvani

(57) ABSTRACT

An air handling unit includes a housing constructed from a plurality of insulation panels embedded with frame elements. The frame elements include at least a first frame element and a second frame element joined together by an inline connector. Each insulation panel includes an outer surface and an opposed inner surface, wherein the insulation panels all cooperate to form a common outer surface of the air handling unit formed of the outer surfaces of the insulation panels and a common inner surface of the air handling unit formed of the inner surfaces of the insulation panels. The common inner surface bounds and defines an interior space of the air handling unit. The frame elements are all inboard of the common outer surface, recessed and embedded within the insulation panels.

20 Claims, 10 Drawing Sheets

AIR HANDLING UNIT CONSTRUCTION

FIELD

The present invention relates generally to construction techniques, and more particularly to thermal insulation and air handling unit construction techniques.

BACKGROUND

Buildings, warehouses, factories, housings, portable structures, and other facilities have different requirements for conditioning their air. Data centers require cooled air. EV battery manufacturing facilities need extremely low humidity levels. Indoor agricultural sites have a variety of environmental needs.

Specialized industries have specific demands for their air and turn to specially designed air handling units to condition the air. These units may be large and stand alone to house the machinery, servers, or other working components, or they may be appurtenant to a factory or warehouse. Air handling units are typically highly engineered to filter environmental air and condition it as needed. To maintain control, the walls of the units are usually heavily insulated.

Conventionally, most air handling units for industry use a two-inch thick wall. The walls are usually assembled in one of two ways. Like stick-building construction methods for homes, some units are built out with frames first, and insulation is then placed outside of the frames. In another method of construction, frame elements and insulation panels couple to form a monocoque-like structure.

The frame elements are usually limited in length. The size of a cargo container is often the constraint factor; frame elements can only be so big so as to still fit onto a container ship for transportation. For example, usually, frame elements cannot be big longer than eighteen feet. This means that, when frame elements are assembled into an air handling unit, the unit can not be longer than eighteen feet.

This often results in compartmentalized construction of the air handling unit and/or exposed frame elements, both of which reduce the efficacy and efficiency of the unit. For example, many large air handling units are actually built in two or three separate, free-standing modules and then coupled together to form one larger assembled unit. Such units can have boxy construction, complicated structural engineering requirements, leakage, and poor air conditioning performance characteristics.

Moreover, some customers require single-compartment air handling units. Where air must move through many filtering and conditioning components without interruption by solid walls, a modular construction technique cannot be used. Interior spaces that are segmented by structural elements—such as where two air handling unit housings are brought together to form one larger unit—may not meet a customer's performance requirements. However, there currently is no construction technique that allows for large air handling units with single, continuous, unbroken interiors.

Still further, some industries require air units which perform so precisely that the conventional two-inch wall is not sufficient. In such situations, a four-inch wall is appropriate. However, no existing construction method or equipment accommodates a four-inch thick panel. There is a need for an improved construction of air handling units.

SUMMARY

In an embodiment, an air handling unit includes a frame element, and first and second insulation panels which confront the frame element at a juncture. The first insulation panel includes a first distal surface, a first proximal surface, a first intermediate surface extending between the first distal and proximal surfaces, and a first inner surface. The second insulation panel includes a second distal surface, a second proximal surface, a second intermediate surface extending between the second distal and proximal surfaces, and a second inner surface. At the juncture, the second distal surface faces the first intermediate surface at an insulation seam, the second proximal surface faces in spaced relation the first intermediate surface and the second intermediate surface faces in spaced relation the first proximal surface, thereby defining a closed void defined between the first intermediate surface, the first proximal surface, the second intermediate surface, and the second proximal surface; and the frame element occupies the closed void. A first air-impermeable seal is in the insulation seam, second air-impermeable seals are between the frame element and the first and second intermediate surfaces, respectively, and between the frame element and the first and second inner surfaces, respectively, and third air-impermeable seals are between the frame element and the first and second proximal surfaces, respectively.

In some embodiments of an air handling unit, the first distal surface is parallel to the first proximal surface, and the second distal surface is parallel to the second proximal surface. The first intermediate surface is normal to the first distal surface and to the first proximal surface, and the second intermediate surface is normal to the second distal surface and to the second proximal surface; and the first inner surface is normal to the first distal surface and to the first proximal surface, and the second inner surface is normal to the second distal surface and to the second proximal surface.

In some embodiments of an air handling unit, the first and second insulation panels are normal to each other. At the juncture, the first insulation panel overlaps the second insulation panel.

In some embodiments of an air handling unit, the first air-impermeable seal in the insulation seam is a sealant extending along the insulation seam. The second air-impermeable seal between the frame element and the first intermediate surface includes two gaskets each extending along a length of the frame element. The second air-impermeable seal between the frame element and the second intermediate surface includes another two gaskets each extending along the length of the frame element. The second air-impermeable seal between the frame element and the first inner surface includes another gasket extending along the length of the frame element. The second air-impermeable seal between the frame element and the second inner surface includes yet another gasket extending along the length of the frame element. The third air-impermeable seal between the frame element and the first proximal surface is another sealant extending along a length of the frame element. The third air-impermeable seal between the frame element and the second proximal surface is yet another sealant extending along the length of the frame element.

In an embodiment, an air handling unit includes a frame element, and first and second insulation panels which confront the frame element at a juncture. The first insulation panel includes a first distal surface, a first proximal surface, a first intermediate surface extending between the first distal and proximal surfaces, and a first inner surface. The second insulation panel includes a second distal surface, a second proximal surface, a second intermediate surface extending between the second distal and proximal surfaces, and a second inner surface. At the juncture, the first distal surface faces the second distal surface at an insulation seam, the first intermediate surface is registered in alignment with the second intermediate surface, the first proximal surface faces the second proximal surface in spaced relation, thereby defining an open void between the first intermediate surface, the first proximal surface, the second intermediate surface, and the second proximal surface. The frame element occupies the open void. A first air-impermeable seal is in the insulation seam, second air-impermeable seals are between the frame element and the first and second intermediate surfaces, respectively, and between the frame element and the first second inner surfaces, respectively, and third air-impermeable seals are between the frame element and the first and second proximal surfaces, respectively.

In some embodiments of an air handling unit, the first distal surface is parallel to the first proximal surface, and the second distal surface is parallel to the second proximal surface. The first intermediate surface is normal to the first distal surface and to the first proximal surface, and the second intermediate surface is normal to the second distal surface and to the second proximal surface. The first inner surface is normal to the first distal surface and to the first proximal surface, and the second inner surface is normal to the second distal surface and to the second proximal surface.

In some embodiments of an air handling unit, the first and second insulation panels are registered in alignment with each other, and at the juncture, the first insulation panel abuts the second insulation panel.

In some embodiments of an air handling unit, the first air-impermeable seal in the insulation seam is a sealant extending along the insulation seam. The second air-impermeable seal between the frame element and the first intermediate surface includes two gaskets each extending along a length of the frame element. The second air-impermeable seal between the frame element and the second intermediate surface includes another two gaskets each extending along the length of the frame element. The second air-impermeable seal between the frame element and the first inner surface includes another gasket extending along a length of the frame element, the second air-impermeable seal between the frame element and the second inner surface includes yet another gasket extending along the length of the frame element, the third air-impermeable seal between the frame element and the first proximal surface is another sealant extending a length of the frame element, and the third air-impermeable seal between the frame element and the second proximal surface is yet another sealant extending along the length of the frame element.

In an embodiment, an air handling unit includes a housing constructed from a plurality of insulation panels embedded with frame elements. The frame elements include at least a first frame element and a second frame element joined together by an inline connector. Each insulation panel includes an outer surface and an opposed inner surface, wherein the insulation panels all cooperate to form (1) a common outer surface of the air handling unit included of the outer surfaces of the insulation panels and (2) a common inner surface of the air handling unit included of the inner surfaces of the insulation panels. The common inner surface bounds and defines an interior space of the air handling unit. The frame elements are all inboard of the common outer surface, recessed and embedded within the insulation panels.

In some embodiments of an air handling unit, the inline connector includes a middle section, a first mating portion extending from the middle section in a first direction to a first end, a second mating portion extending from the middle section in a second direction, opposite the first direction, to a second end, the first mating portion including a first major plug and a first minor plug, wherein the first major and minor plugs are configured to fit into sockets in the frame elements, the second mating portion including a second major plug and a second minor plug, wherein the second major and minor plugs are configured to fit into the sockets in the frame elements, and the middle section includes a generally rectangular prismatic body having a dimension larger than the first and second mating portions, and two flanges projecting outwardly away from the body.

In some embodiments of an air handling unit, the first major plug and the first minor plug are separated by a slender first gap. The second major plug and the second minor plug are separated by a slender second gap.

In some embodiments of an air handling unit, the flanges are proximate the first and second minor plugs.

In some embodiments of an air handling unit, the insulation panels include at least a first insulation panel and a second insulation panel confronting one of the frame elements at a juncture. The first insulation panel includes a first distal surface, a first proximal surface, a first intermediate surface extending between the first distal and proximal surfaces, and a first inner surface. The second insulation panel includes a second distal surface, a second proximal surface, a second intermediate surface extending between the second distal and proximal surfaces, and a second inner surface. At the juncture, the second distal surface faces the first intermediate surface at an insulation seam. The second proximal surface faces in spaced relation the first intermediate surface and the second intermediate surface faces in spaced relation the first proximal surface, thereby defining a closed void between the first intermediate surface, the first proximal surface, the second intermediate surface, and the second proximal surface. At least one of the first and second frame elements occupies the closed void.

In some embodiments of an air handling unit, a first air-impermeable seal is in the insulation seam. Second air-impermeable seals are between the frame element and the first and second intermediate surfaces, respectively, and between the frame element and the first and second inner surfaces, respectively. Third air-impermeable seals are between the frame element and the first and second proximal surfaces, respectively.

In some embodiments of an air handling unit, the first air-impermeable seal in the insulation seam is a sealant extending along the insulation seam. The second air-impermeable seal between the frame element and the first intermediate surface includes two gaskets each extending along a length of the frame element. The second air-impermeable seal between the frame element and the second intermediate surface includes another two gaskets each extending along the length of the frame element. The second air-impermeable seal between the frame element and the first inner surface includes another gasket extending along the length of the frame element. The second air-impermeable seal between the frame element and the second inner surface includes yet another gasket extending along the length of the frame element. The third air-impermeable seal between the frame element and the first proximal surface is another sealant extending along a length of the frame element. The third air-impermeable seal between the frame element and the second proximal surface is yet another sealant extending along the length of the frame element.

In some embodiments of an air handling unit, the first distal surface is parallel to the first proximal surface, and the second distal surface is parallel to the second proximal surface. The first intermediate surface is normal to the first distal surface and to the first proximal surface, and the second intermediate surface is normal to the second distal surface and to the second proximal surface. The first inner surface is normal to the first distal surface and to the first proximal surface, and the second inner surface is normal to the second distal surface and to the second proximal surface.

In some embodiments of an air handling unit, the insulation panels include at least a first insulation panel and a second insulation panel confronting one of the frame elements at a juncture. The first insulation panel includes a first distal surface, a first proximal surface, a first intermediate surface extending between the first distal and proximal surfaces, and a first inner surface. The second insulation panel includes a second distal surface, a second proximal surface, a second intermediate surface extending between the second distal and proximal surfaces, and a second inner surface. At the juncture: the first distal surface faces the second distal surface at an insulation seam. The first intermediate surface is registered in alignment with the second intermediate surface. The first proximal surface faces the second proximal surface in spaced relation, thereby defining an open void between the first intermediate surface, the first proximal surface, the second intermediate surface, and the second proximal surface. At least one of the first and second frame elements occupies the open void.

In some embodiments of an air handling unit, a first air-impermeable seal is in the insulation seam. Second air-impermeable seals are between the frame element and the first and second intermediate surfaces, respectively, and between the frame element and the first second inner surfaces, respectively. Third air-impermeable seals are between the frame element and the first and second proximal surfaces, respectively.

In some embodiments of an air handling unit, the first air-impermeable seal in the insulation seam is a sealant extending along the insulation seam. The second air-impermeable seal between the frame element and the first intermediate surface includes two gaskets each extending along a length of the frame element. The second air-impermeable seal between the frame element and the second intermediate surface includes another two gaskets each extending along the length of the frame element. The second air-impermeable seal between the frame element and the first inner surface includes another gasket extending along a length of the frame element. The second air-impermeable seal between the frame element and the second inner surface includes yet another gasket extending along the length of the frame element. The third air-impermeable seal between the frame element and the first proximal surface is another sealant extending a length of the frame element, and the third air-impermeable seal between the frame element and the second proximal surface is yet another sealant extending along the length of the frame element.

In some embodiments of an air handling unit, the first distal surface is parallel to the first proximal surface, and the second distal surface is parallel to the second proximal surface. The first intermediate surface is normal to the first distal surface and to the first proximal surface, and the second intermediate surface is normal to the second distal surface and to the second proximal surface. The first inner surface is normal to the first distal surface and to the first proximal surface, and the second inner surface is normal to the second distal surface and to the second proximal surface.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
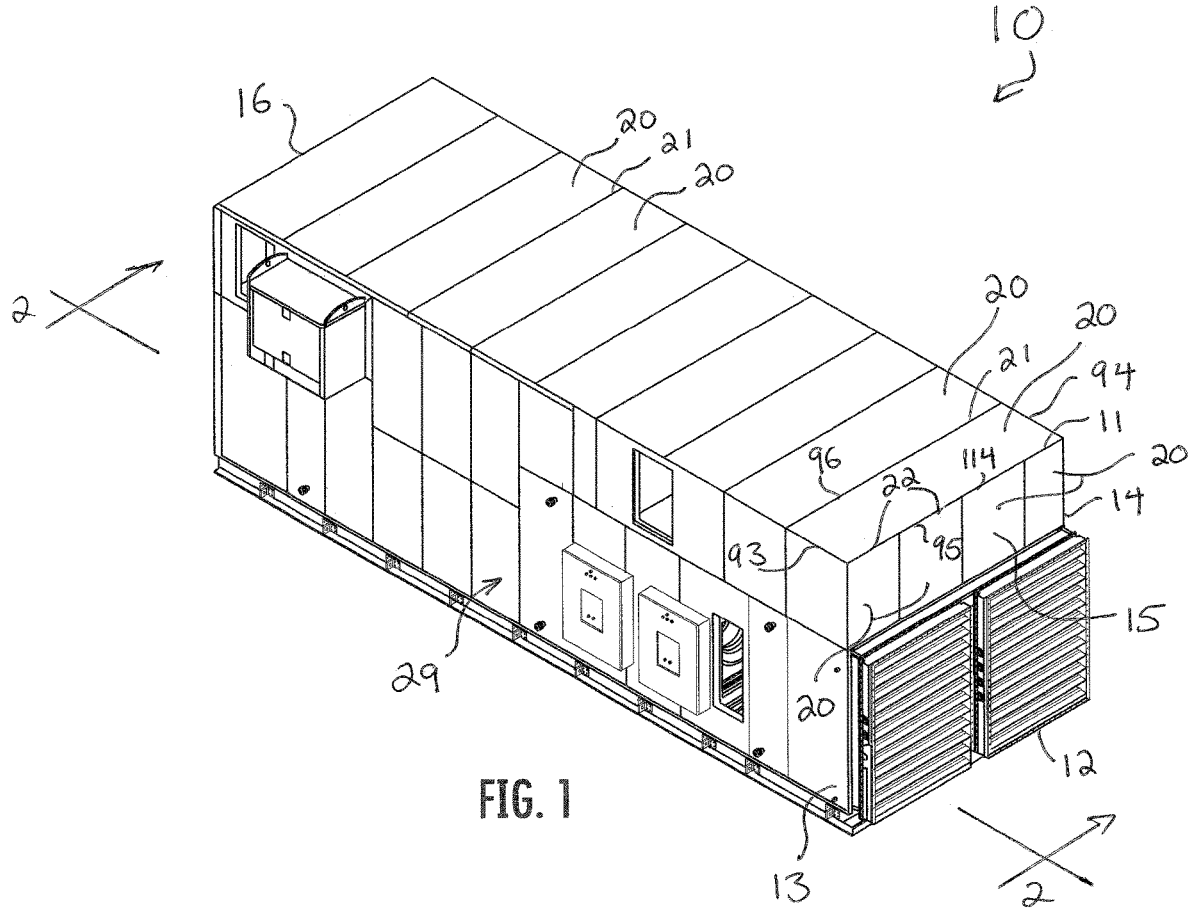
FIG. 1 is a front perspective view of an air handling unit.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 illustrates an air handling unit 10 assembled with a four-inch wall construction technique that enhances the thermal insulation of an enclosed space within the unit 10. The air handling unit 10 shown here is exemplary; it illustrates components that can be used to create and assemble smaller, larger, and differently-shaped units. As such, while this specification describes the structural elements, features, and construction techniques of the unit 10 shown in the drawings, the description is not so limited and should be understood to apply to air handling units of other sizes and shapes assembled with the structural elements, features, and construction techniques described herein.

The unit 10 includes a top 11, an opposed bottom 12, a front 13, an opposed back 14, and opposed ends 15 and 16. Throughout this description, reference will be made to these locations both as absolute locations and as directional cues.

For example, if a first element is described as being above a second element, the reader should understand that the first element is closer to the top 11 than is the second element.

As can be seen fairly clearly in FIG. 1, the unit 10 is constructed with a large plurality of insulation panels 20 (referred to herein n as either "insulation panels" or just "panels"), most of which are preferably rectangular. The panels 20 are laid up in abutting relationship with each other to define seams 21 between adjacent panels 20, such as is shown along the top 11 among several horizontally-arranged panels 20. The panels 20 are also arranged in abutting relationship with each other to define corners 22 formed between panels 20 which are transverse to each other. Here, corners 22 are formed between panels 20 which are not just transverse but are actually normal to each other; in other embodiments, other angles between panels 20 are present.

The unit 10 additionally includes other features, such as intake and exhaust vents, power supplies, and access doors. These features are not discussed further but are visible in many of the drawings. This unit 10 is large, at approximately ten feet high from the bottom 12 to the top 11, ten feet wide from the front 13 to the back 14, and twenty-five feet long between the opposed ends 15 and 16. Continuous-compartment construction of this unit 10 using conventional techniques would be impossible.

Figure 2:
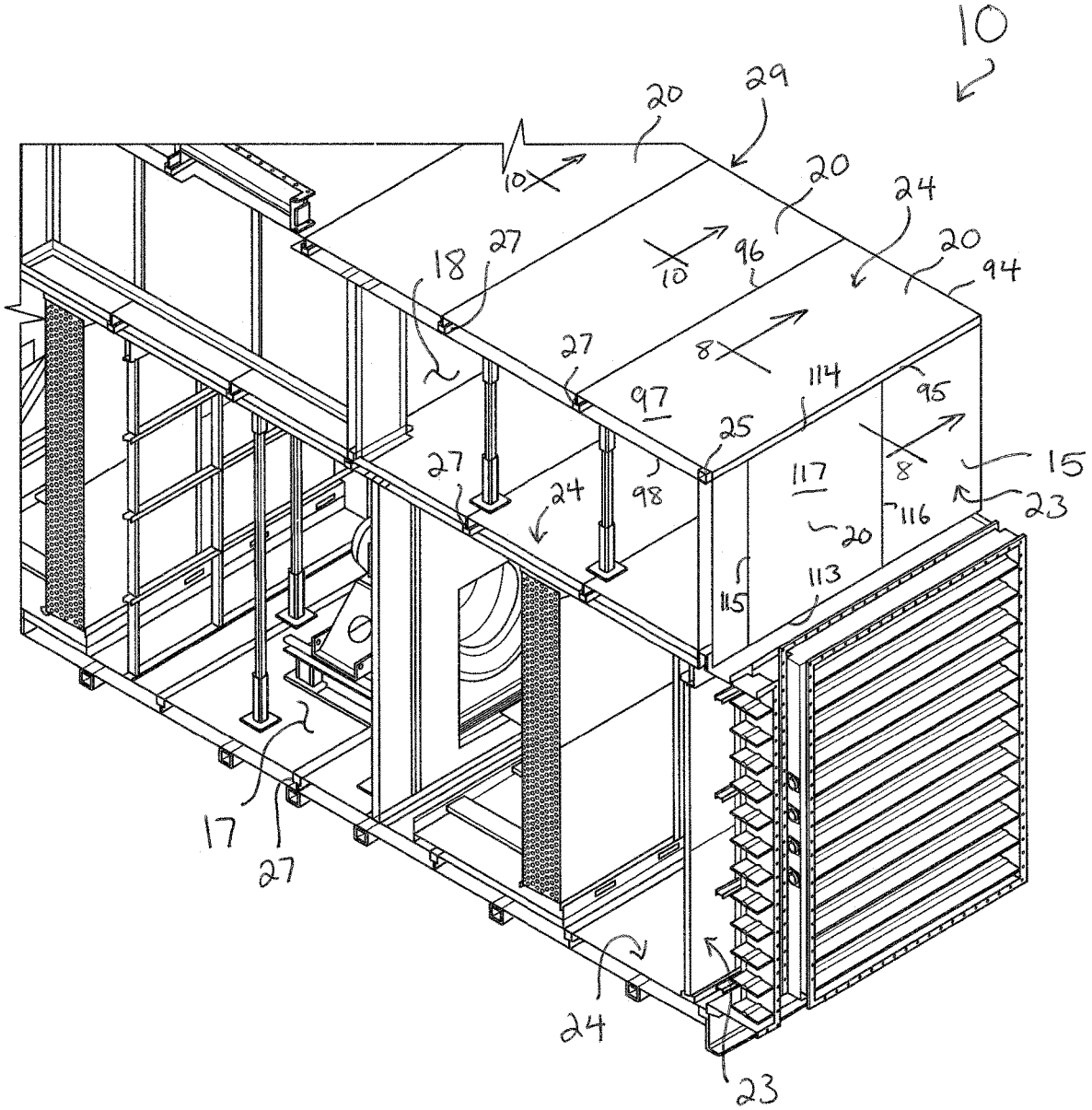
FIG. 2 is a section view taken along the line 2-2 of FIG. 1 showing interiors of the air handling unit.

FIG. 2 illustrates a section view of the air handling unit 10 take along the line 2-2 in FIG. 1. FIG. 2 shows a lower interior 17 and an upper interior 18 of the unit 10. The two interiors 17 and 18 are separated here by a horizontal surface —a floor of the upper interior 18 and a ceiling of the lower interior 17.

However, this separation is purely exemplary to illustrate the possibility of separation if needed. The reader will understand after reviewing this specification that the horizontal floor separating the interiors 17 and 18 could be removed without alteration of the construction and structural characteristics of the unit 10. The lower interior 17 is continuous from end 15 to end 16, as is the upper interior 18. It would not be possible to have two continuous interiors 17 and 18 using conventional construction techniques.

The unit 10 is constructed with vertical walls and horizontal floors. FIG. 2 shows two walls 23 and three floors 24. The two walls 23 are at the end 15, and the three floors 24 are arranged in spaced-apart relation, one above the other, with the top floor 24 at the top 11.

Each wall 23 is constructed and assembled as a unitary, continuous piece from insulation panels 20 and frame elements 25 and 27 embedded therein. In other words, one wall 23 extends entirely from the front 13 of the unit 10 to the back 14. One wall 23 extends entirely from the end 15 to the end 16. The walls 23 are constructed from multiple frame elements 25 and 27 and insulation panels 20, but together, those parts cooperate to form a single, continuous wall 23. These walls 23 can be extremely long, effectively without limit to length. This enables building of the unit 20 with continuous compartments. During assembly, entirely complete walls 23 are raised and coupled to each other and to the floors 24, rather than assembling the walls and floors piecemeal or as separate components.

Similarly, each floor 24 is constructed and assembled as a unitary, continuous piece from insulation panels 20 and frame elements 25 and 27. In other words, one floor 24 extends entirely from the front 13 of the unit 10 to the back 14 and from the end 15 to the end 16. The floors 24 are constructed from multiple frame elements 25 and 27 and insulation panels 20, but together, those parts cooperate to form a single, continuous floor 24. The floors 24 can be extremely long, effectively without to length and width. This enables building of the unit 20 with continuous compartments.

The frame elements 25 and 27 are embedded or nested within the insulation panels 20. Each insulation panel 20 includes at least one notch which cooperates with a similar notch in an adjacent insulation panel 20 to define a void which receives a frame element 25 or 27. There, the insulation panels 20 are secured to the frame element 25 or 27. By embedding the frame elements 25 or 27 between the insulation panels 20 and then connecting the frame elements 25 or 27 to each other, a large wall 23 or floor 24 can be constructed. The size of the resultant wall 23 or floor 24 is determined by the length of the frame elements 25. The frame elements 25 and can be connected end-to-end to construct assemblies of frame elements 25 and 27 with longer effective lengths.

Figure 3:
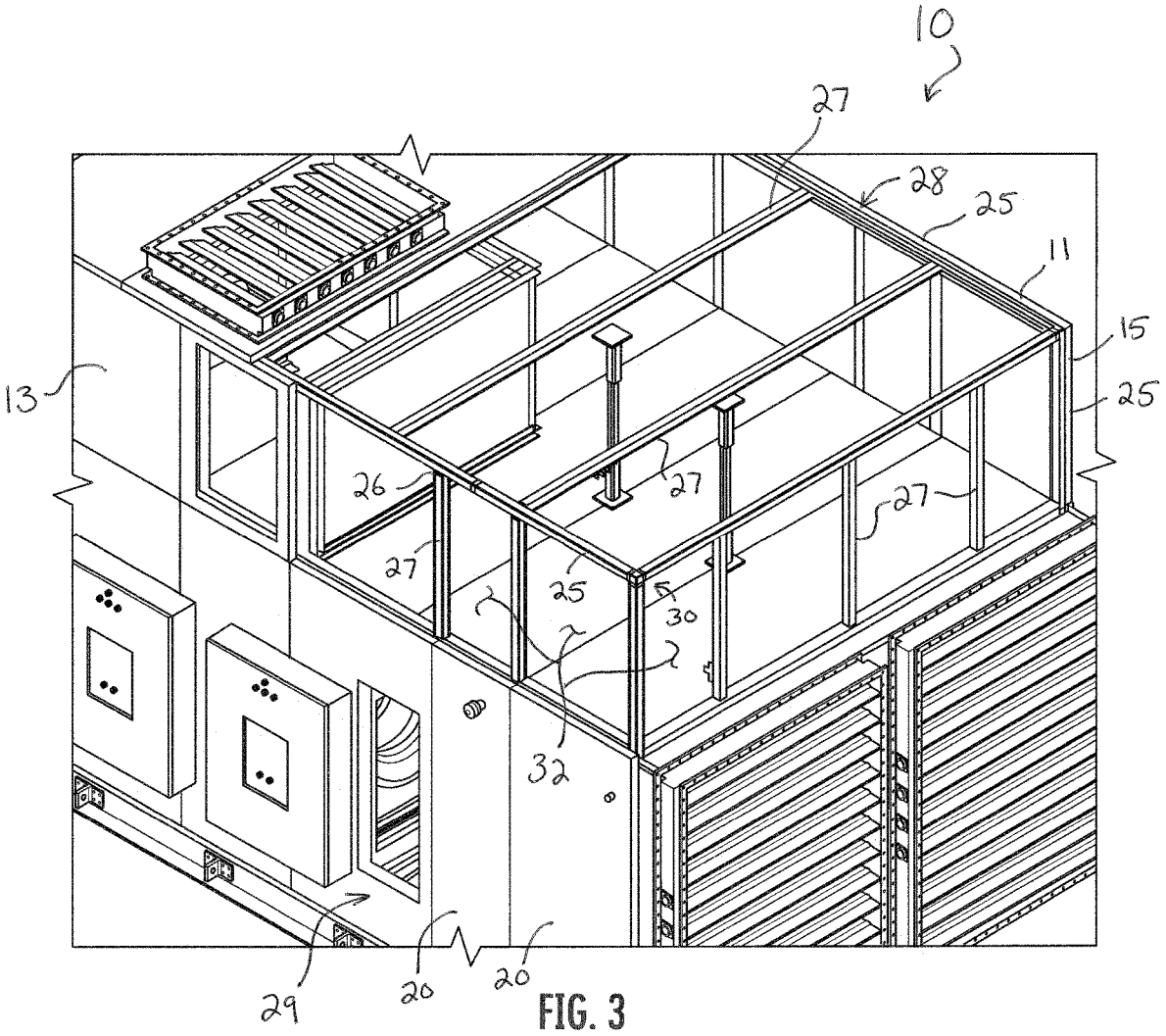
FIG. 3 is an enlarged front perspective view of the air handling unit with insulation panels removed to show frame elements of the air handling unit.

FIG. 3 shows an upper portion of the unit 10 with many of the insulation panels removed, so that the frame elements 25 and 27 can be seen. There are many frame elements 25 and 27, extending both vertically and horizontally. Each of the frame elements 25 is identical to the other, and each of the frame elements 27 are identical to each other. The frame elements 25 and 27 are quite similar, however, and so for much of this description, the reference character 25 is used to describe both. Nonetheless, where appropriate and helpful for understanding, the description separately identifies the frame elements 25 and 27. The frame elements 25 and 27 cooperate to form a frame 28 of the unit 10, and when insulation panels 20 are added to that frame 28, they cooperate to define a housing 29 of the kind shown in FIGS. 1-3. The housing 29 is a boundary between the environment and the conditioned air in the interiors 17 and 18.

The frame elements 25 are coupled to each other with different couplings. At the corner between the top 11 and the end 15, several vertical frame elements 25 and 27 are coupled to the underside of a horizontal frame element 25 extending along that corner. Similarly, at the corner between the top 11 and the front 13, several vertical frame elements 25 and 27 are coupled to the underside of a horizontal frame element 25 extending that corner. The top of each vertical frame element 27 is secured with a cap 26, and the screws extend from the cap 26 into the horizontal frame element. The cap 26 rigidly and securely couples the vertical frame element 27 to the horizontal frame element 25 at that corner. The cap 26 can be seen better in FIG. 4, which is an enlarged view of FIG. 3 detailing part of an outside corner 30 of the unit 10.

At the corner 30, three frame elements 25 are coupled with a corner connector 31. Each of the frame elements 25 is coupled rigidly and securely to the corner connector 31. Elements such as the cap 26 and the corner connector 31 enable the walls 23 and floors 24 to be built to accommodate the insulation panels 20. By spacing apart the intermediate frame elements 27—the frame elements 27 between the frame elements 25 at the ends or sides of the wall 23 or floor 24, holds 32 are created to receive the insulation panels 20, which can be placed precisely into the holds 32 with a snug fit between the frame elements 25.

Figure 4:
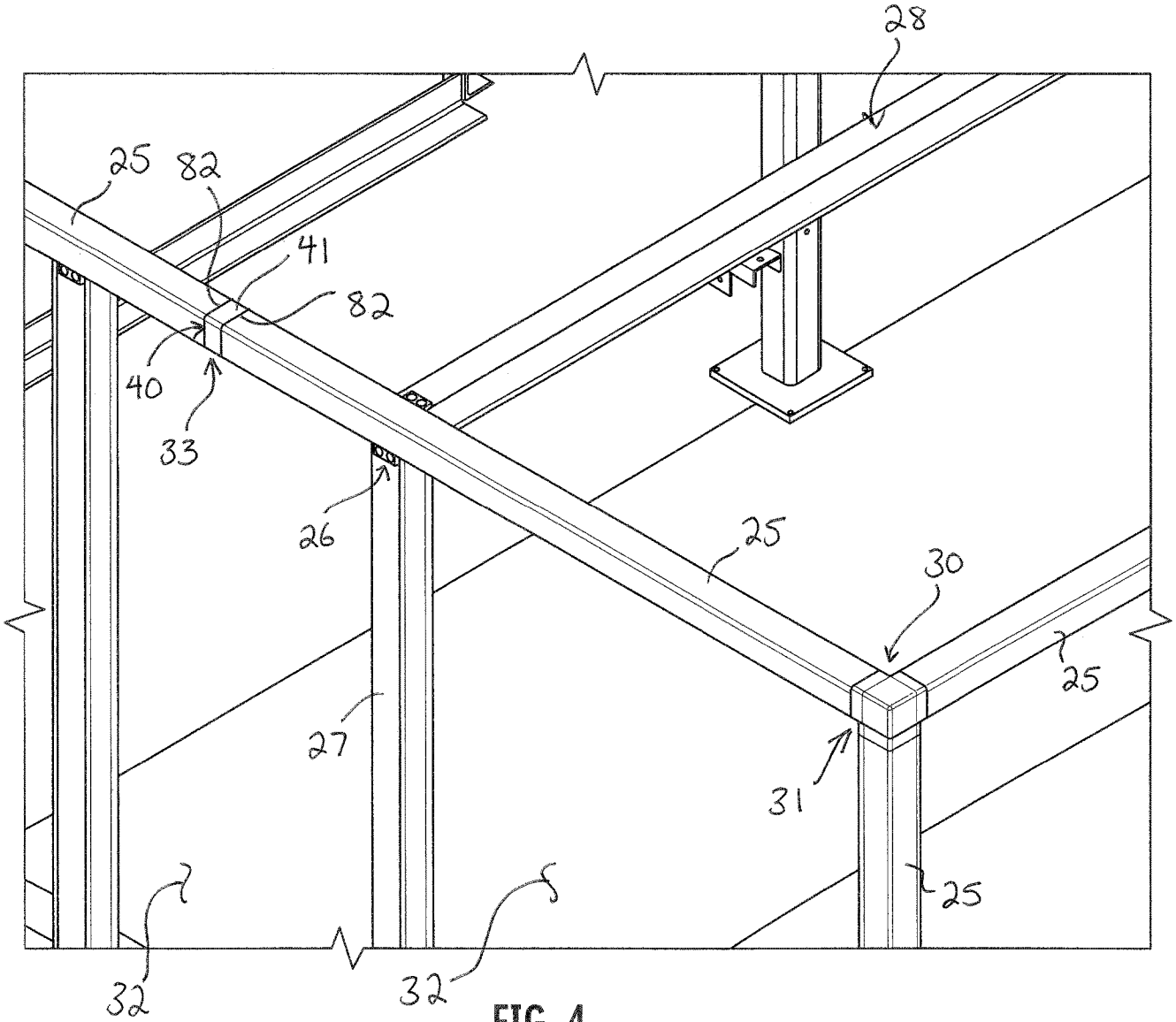
FIG. 4 is an enlarged view of FIG. 3.
Figure 5:
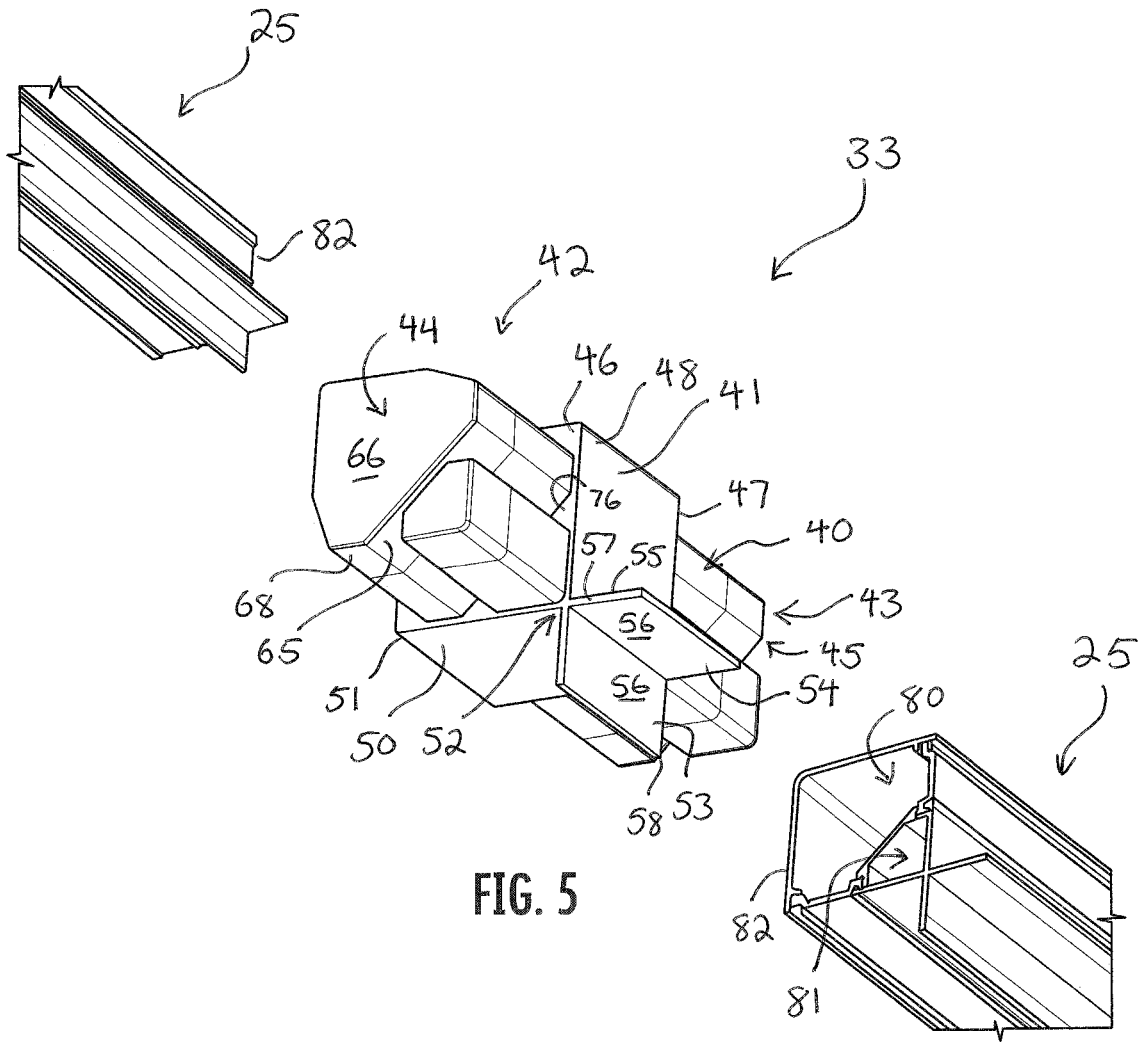
FIGS. 5-7 are views of an inline connector for coupling the frame elements.
Figure 6:
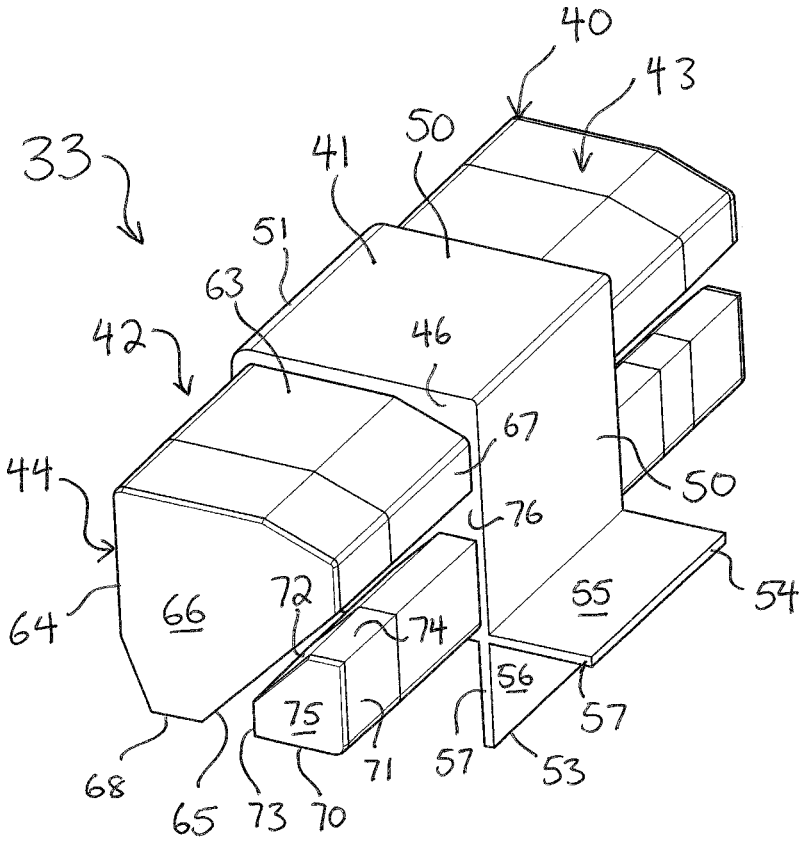
Figure 7:
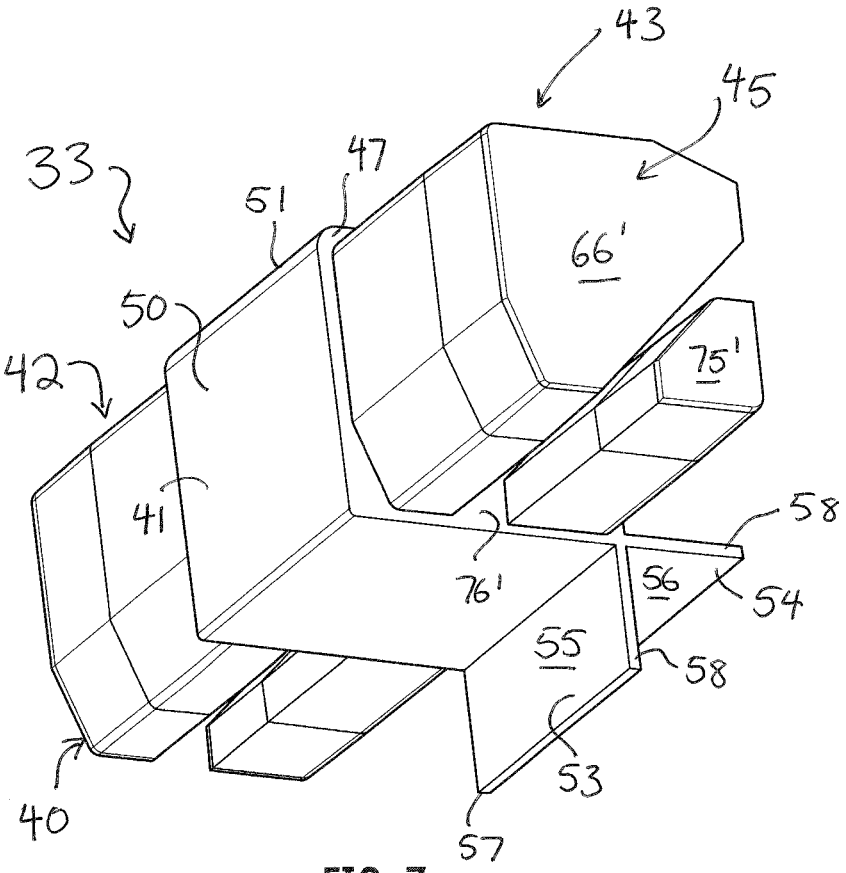

The walls 23 and floors 24 may be built as long as needed by extending the length of some of the frame elements 25. Referring now to FIG. 4, an inline connector 33 is shown between two frame elements 25. The inline connector 33 has a body 40 with a middle section 41 and two mating portions 42 and 43 which extend from the middle section 41 in opposite directions from each other. FIG. 4 shows only the middle section 41, as the two mating portions 42 and 43 receive the adjacent frame elements 25 and are hidden by them. FIGS. 5-7 show the inline connector 33 in additional detail.

The inline connector 33 has a first end 44, visible in FIG. 5, and an opposed second end 45, hidden in FIG. 5 but identical to the first end 44. The second end 45 is visible in FIG. 7, which shows the inline connector 33 from a perspective roughly opposite that of FIG. 5. The middle section 41 of the body 40 is disposed intermediate the first and second ends 44 and 45. The middle section 41 is generally rectangular prismatic having opposed first and second faces 46 and 47 and a prismatic sidewall 48 extending therebetween. The prismatic sidewall 48 includes four major sides faces 50. Chamfers between adjacent side faces 50 form very slender, minor, oblique faces 51.

As shown best in FIG. 5, two of the major side faces 50 meet at an inside corner 52 from which two flanges 53 and 54 project outwardly away from the body 40. The flanges 53 and 54 are identical in every respect except location and orientation. Each extends from the inside corner 52 normal to the major side face 50 to which it is adjacent. The flanges 53 and 54 are thus normal to each other. The flanges 53 and 54 are thin.

Each flange 53 and 54 has a first or inner face 55 and an opposed second or outer face 56. Between these faces 55 and 56, each flange 53 and 54 has a small thickness. Each of the flanges 53 and 54 has first and second ends 57 and 58. The flanges 53 and 54 are coextensive to the middle section 41 between its first and second faces 46 and 47. In other words, the flanges 53 and 54 preferably terminate at the first and second ends 57 and 58 no further or closer to the first and second ends 44 and 45 than the first and second faces 46 and 47, respectively. The first and second ends 57 and 58 of the flanges 53 and 54 are thus flush with the first and second faces 46 and 47 of the middle section 41.

The middle section 41 and the flanges 53 and 54 are a single, unitary, monolithic structure. The middle section 41 is preferably solid. Extending from the middle section as unitary monolithic extensions are the first and second mating portions 42 and 43 which are also preferably solid. The entire inline connection 33 is constructed of a material or combination of materials which have material characteristics of durability, ruggedness, rigidity, strength, thermal insulation, and which can withstand extremely high temperatures without altering these material characteristics and without deforming.

The first and second mating portions 42 and 43 are identical in every respect except location and orientation. As such, this specification will primarily describe the first mating portion 42, with the understanding that the description applies equally to the second mating portion 43 unless otherwise stated. Moreover, the reference characters used to identify the structural elements and features of the first mating portion 42 are also used to identify those same structural elements and features of the second mating portion 43 but are marked with a prime ("") symbol on the second mating portion 43 to distinguish them.

The first mating portion 42 includes a major plug 60 and a minor plug 61, spaced apart by a slender gap 62. The major plug 60 extends outwardly from the first face 46. The major plug 60 includes a top 63, an adjacent side 64, and a diagonal bottom 65 extending between the top 63 and bottom 65. Minor faces 67 and 68 are formed as chamfers between the diagonal bottom 65 and the top 63 and side 64, respectively. The top 63 includes two faces oriented slightly transverse with respect to each other. Similarly, the side 64 includes oriented slightly transverse with respect to each other. The diagonal bottom 65 is a single flat face. The adjacent faces of the top 63 and side 64 are normal to each other. All of the faces of the top 63, side 64, and bottom 65 the major plug 60 are normal to the first face 46. In some embodiments, these faces taper slightly from the first face 46 to the first end 44. The major plug 60 terminates at the first end 44 with a flat endwall 66.

The minor plug 61 extends outwardly from the first face 46. The minor plug includes a bottom 70, an adjacent side 71, and a diagonal top 72 extending between the bottom 70 and side 71. The bottom 70 has a single flat face, the side 71 has a single flat face, and the diagonal top 72 has a single flat face. Minor faces 73 and 74 are formed as chamfers between the diagonal top 72 and the bottom 70 and side 71, respectively. The bottom 70 and side 71 are normal to each other. All of the faces of the bottom 70, side 71, and top 72 are normal to the first face 46. In some embodiments, these faces taper slightly from the first face 46 to the first end 44. The minor plug 61 terminates at the first end 44 with a flat endwall 75.

The major and minor plugs 60 and 61 are spaced apart from each other. The bottom 65 of the major plug 60 and the top 72 of the minor plug 61 are parallel and spaced apart from each other by the gap 62. Together, the major and minor plugs 60 and 61 occupy nearly the entirety of the first face 46, leaving only a small confrontation surface 76 of the first face 46 not consumed by the major and minor plugs 60 and 61. The body 40 has an outer dimension which is larger than the mating portions 42 and 43, but only slightly larger, such that the confrontation surface 76 is relatively thin, but at least large enough to encounter and confront a thin metal sidewall and internal rib of a frame element 25.

As shown in FIG. 5, the inline connector 33 fits between and receives two adjacent frame elements 25. The frame elements 25 each have a major socket 80 and a minor socket 81 which are open at the ends 82 of the frame elements 25 and which are separated by a thin rib. These sockets 80 and 81 correspond to the shapes and sizes of the inline connector 33. To connect the frame elements 25, the first mating portion 42 is pressed into the end 82 of one frame element 25, and the second mating portion 43 is pressed into the end 82 of the other frame element 25. The major plugs 60 are press-fit into the major sockets 80 and the minor plugs 61 are press-fit into the minor sockets 81 until the ends 82 of the frame elements 25 encounter in abutment the first and second faces 46 and 47 of the middle section 41. The flanges 53 and 54 are proximate the minor plugs 60 and encounter corresponding flanges on the frame elements 25.

When so arranged, the mating portions 42 and 43 are entirely within the frame elements 25, only the middle section 41 of the inline connector 33 is visible, and the frame elements 25 are separated by the middle section 41, as shown in FIG. 4. This couples the adjacent frame elements 25 together in registered alignment and creates a strong connection between them. The frame elements 25 now form a much longer assembly of frame elements 25. Additional frame elements 25 can be coupled to this assembly in a similar fashion to construct a frame element 25 assembly that extends along the entire length of the unit 10 from end 15 to end 16.

Figure 8:
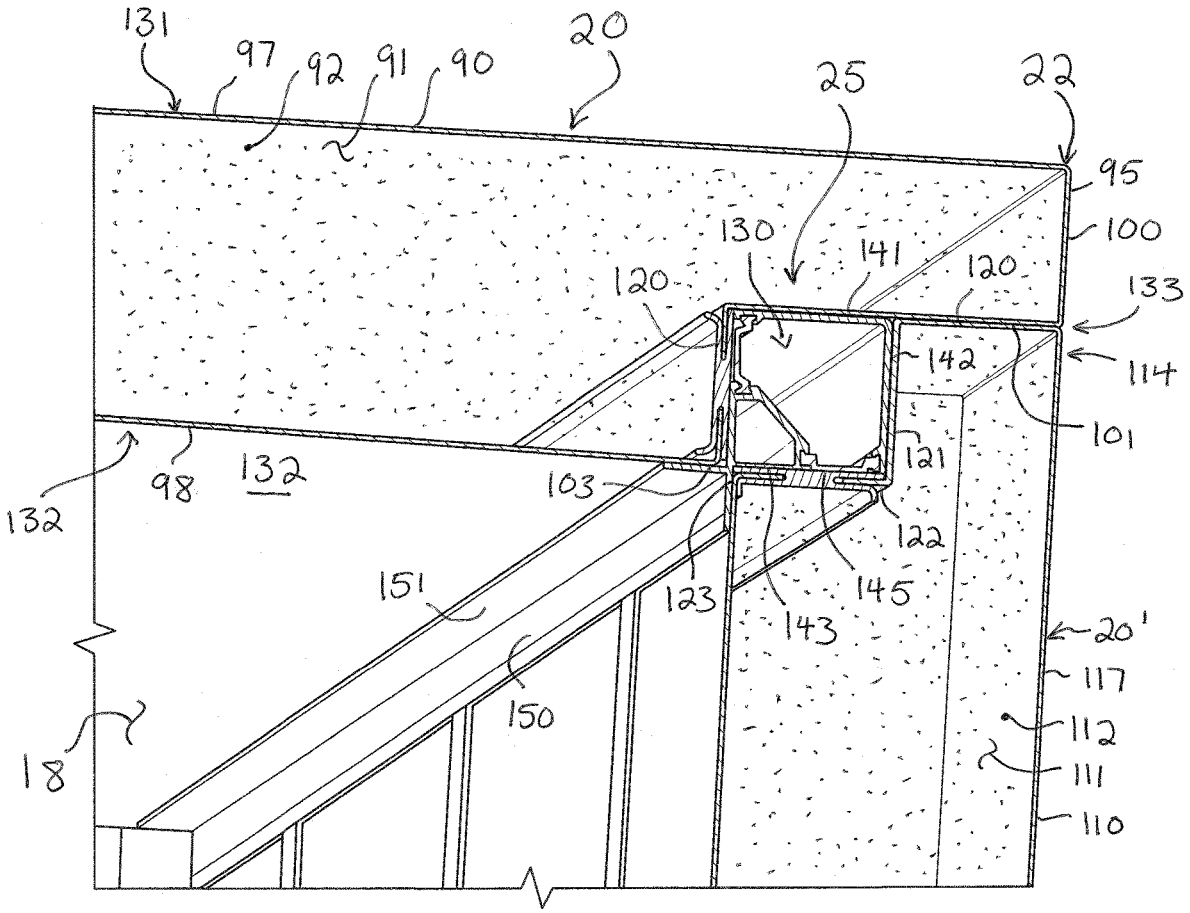
FIG. 8 is a section view taken along the line 8-8 of FIG. 2 showing insulation panels meeting and confronting a frame element at a juncture.
Figure 9:
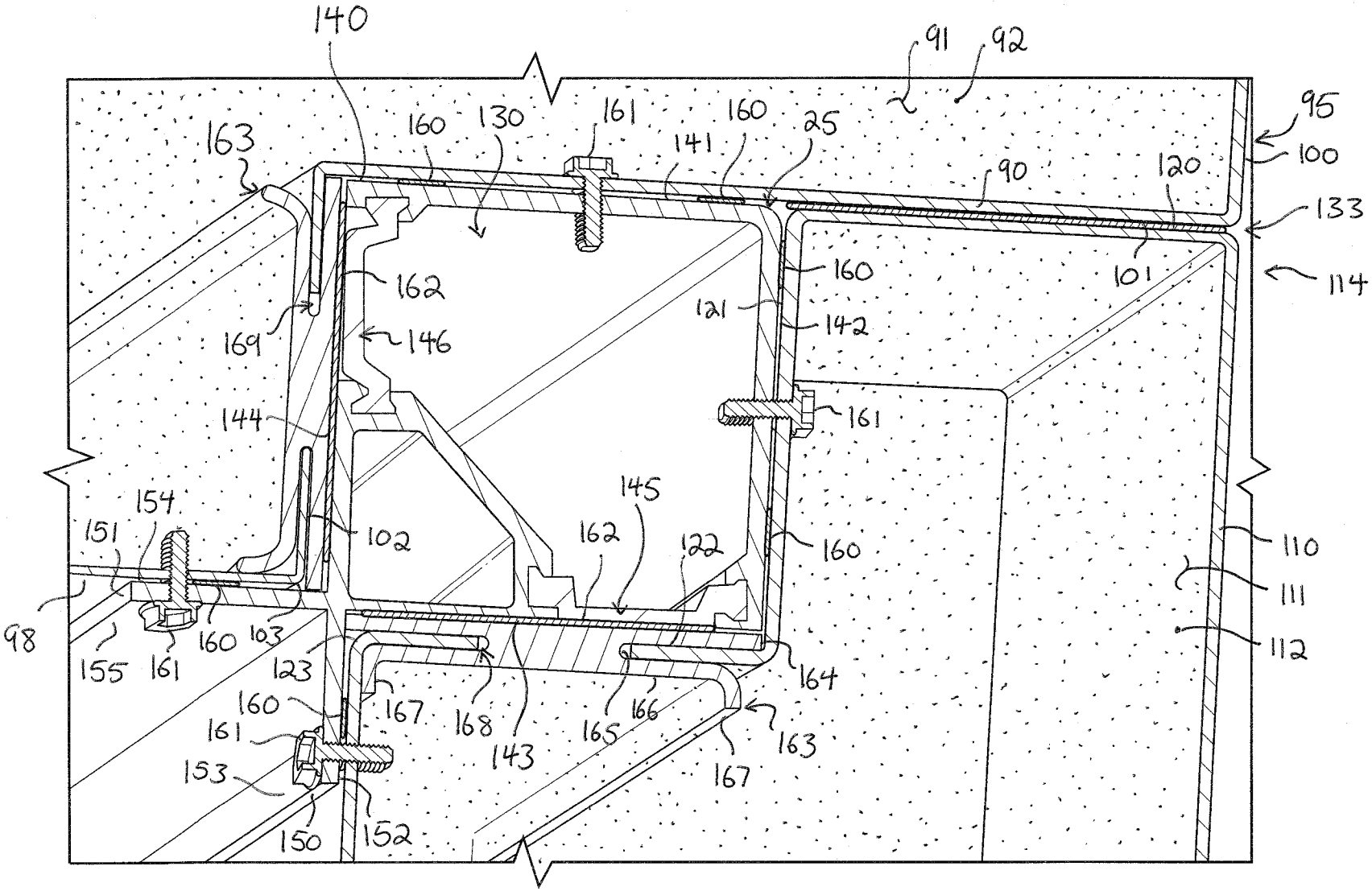
FIG. 9 is an enlarged view of FIG. 8.

Constructing long assemblies of frame elements 25 allows a large continuous interior space to be built. However, transverse frame elements 25 must still span between these long assemblies to define the holds 32 into which the insulation panels 20 are fit. FIGS. 8 and 9 illustrate how the insulation panels 20 are embedded and nested with the frame elements 25.

FIGS. 8 and 9 are section views taken along the line 8-8 in FIG. 2. They show a juncture 85 where two insulation panels 20 confront a frame element 25 at a corner 22 of the unit 10. FIG. 8 shows the juncture 85 and surrounding structure, while FIG. 9 shows the frame element 25 in greater detail. Certain features are not shown in detail in FIG. 8 but are shown in FIG. 9, and vice versa. One insulation panel 20 is arranged horizontally and one insulation panel 20 is arranged vertically. For clarity of the ensuing description, and with respect to FIGS. 8 and 9 only, the horizontal insulation panel is identified with the reference character 20 but the vertical insulation panel is identified with the reference character 20'.

The insulation panel 20 includes an outer skin 90 or sheet of metal, such as galvanized stainless steel. The skin 90 wraps around the insulation panel 20, bounding and encasing an interior 91. The interior 91 is filled with insulation 92, shown in FIGS. 8 and 9 as a large plurality of dots. The insulation 92 is preferably expanding foam that expands to fill the entire interior 91.

The insulation panel 20 has opposed ends 93 and 94 and opposed sides 95 and 96 extending between those ends 93 and 94 (see FIGS. 1 and 2). The insulation panel 20 also has an outer surface 97 and an opposed inner surface 98. Between the outer and inner surfaces 97 and 98, the panel 20 preferably has a thickness of four inches. The side 95 of the panel 20 has a stepped profile. It includes a distal surface 100 adjacent to the outer surface 97. The distal surface 100 turns down from the outer surface 97 and is preferably normal thereto.

The distal surface 100 depends from the outer surface 97 approximately two inches, or half the thickness of the panel 20. There, an intermediate surface 101 extends inboard from the distal surface 100. The intermediate surface 101 extends inboard approximately four inches. The intermediate surface 101 is preferably normal to the distal surface 100 and is preferably parallel to the outer surface 97.

The intermediate surface 101 terminates inwardly at a proximal surface 102. The proximal surface 102 turns down, depending from the intermediate surface 101 approximately two inches, or half the thickness of the panel 20. There, the proximal surface 102 meets and forms an inner corner 103 with the inner surface 98 of the panel 20. The proximal surface 102 is parallel to the distal surface 100 and is normal to the outer, inner, and intermediate surfaces 97, 98, and 101.

Similarly, the vertical insulation panel 20' includes an outer skin 110 or sheet of metal, such as galvanized stainless steel. The skin 110 wraps around the insulation panel 20', bounding and encasing an interior 111. The interior 111 is filled with insulation 112, shown in FIGS. 8 and 9 as a large plurality of dots. The insulation 112 is preferably expanding foam that expands to fill the entire interior 111.

The insulation panel 20' has opposed ends 113 and 114 and opposed sides 115 and 116 extending between those ends 113 and 114 (see FIG. 2). The insulation panel 20' also has an outer surface 117 and an opposed inner surface 118. Between the outer and inner surfaces 117 and 118, the panel 20' preferably has a thickness of four inches. The end 114 of the panel 20' has a stepped profile. It includes a distal surface 120 adjacent to the outer surface 117. The distal surface 120 turns down from the outer surface 117 and is preferably normal thereto.

The distal surface 120 depends from the outer surface 117 approximately two inches, or half the thickness of the panel 20'. There, an intermediate surface 121 extends inboard from the distal surface 120. The intermediate surface 121 extends inboard approximately two inches. The intermediate surface 121 is preferably normal to the distal surface 120 and is preferably parallel to the outer surface 117.

The intermediate surface 121 terminates inwardly at a proximal surface 122. The proximal surface 122 turns down, depending from the intermediate surface 121 approximately two inches, or half the thickness of the panel 20'. There, the proximal surface 122 meets and forms an inner corner 123 with the inner surface 118 of the panel 20'. The proximal surface 122 is parallel to the distal surface 120 and is normal to the outer, inner, and intermediate surfaces 117, 118, and 121.

As shown in FIGS. 8 and 9, the horizontal insulation panel 20 is normal to and overlaps the vertical insulation panel 20' at the juncture 85. In other embodiments, this arrangement is reversed. In overlapping arrangement, the insulation panels 20 and 20' cooperate to define a void 130 between the insulation panels 20 and 20' at their side 95 and end 114, respectively. The void 130 has an elongate, rectangular prismatic shape that extends along the full length of the end 114 and the side 95. The void 130 is closed because it is bounded on all sides by the intermediate surface 101, the intermediate surface 121, the proximal surface 102, and the proximal surface 122. The void 130 is sized and shaped to closely receive the frame element 25. The void 130 is inboard of both outer surfaces 97 and 117, recessed within the insulation panels 20 and 20'. It is therefore insulated from the environment. When a frame element 25 is disposed in the void 130, that frame element 25 is received in the void 130 and thus encased or embedded in within the insulation panels, recessed from a common outer surface 131 of the unit 10.

When the insulation panels 20 and 20' overlap in the arrangement as shown in FIGS. 8 and 9, their outer surfaces 97 and 117 cooperate to form a common outer surface 131 of the air handling unit 10 which is continuous across the entire unit 10 except at insulation seams 133 formed between the insulation panels 20. These seams 133 are sealed, however, as described below.

Similarly, the inner surfaces 98 and 118 cooperate to form a common inner surface 132 of the air handling unit 10 which is continuous across the entire unit 10 except where frame elements 27 interrupt it, though those frame elements 27 are well sealed to the adjacent insulation panels 20. The common inner surface 132 bounds and defines the interiors 17 and 18 of the air handling unit 10.

When the insulation panels 20 and 20' overlap as in the arrangement of FIGS. 8 and 9, the distal surface 100 of the panel 20 and the outer surface 117 of the panel 20' are flush, aligned, and contiguous to each other, spaced apart only slightly by the seam 133. The intermediate surface 101 and the distal surface 120 face each other and are just slightly apart in spaced relation with each other. The intermediate surface 101 and the proximal surface 122 face each other but are set apart in spaced relation by the void 130, or approximately two inches. The proximal surface 02 and the intermediate surface 121 face each other and are also set apart in spaced relation by the void 130, or approximately two inches. The inner surfaces 98 and 118 converge proximate each other at the inner corners 103 and 123.

The frame element 25 occupies the void 130. The frame element 25 is an elongate rectangular prismatic member. In the drawings of this embodiment, the frame element 25 has a generally square cross-section as illustrated in FIG. 8. The frame element 25 has a sidewall 140 formed of a combination of metal and plastic thermal breaks. The sidewall 140 includes a top wall 141, a right wall 142, a bottom wall 143, and a left wall 144. These names are selected only to easily identify and refer to the walls shown in FIGS. 8 and 9 and not to limit their description or scope in any way. Each of the walls has an inner face, directed into the frame element 25, and an opposed outer face, directed out of the frame element 25. These inner and outer faces are not labeled with reference characters because it should be clear from the drawings and the description where these faces are located.

The top wall 141 is preferably constructed from metal and extends entirely from the left wall 144 to the right wall 142. Similarly, the right wall is preferably constructed from metal and extends entirely from the top wall 141 to the bottom wall 143.

The bottom wall 142, however, includes a thermal break 145. The thermal break 145 extends in the bottom wall 143 from the right wall 142 to approximately halfway between the right and left walls 142 and 144. The thermal break 145 extends entirely along the length of the frame element 25 and as such, is a thermal discontinuity limiting the transfer of thermal energy through the frame element 25 and from the right wall 142 to the metal portion of the bottom wall 143 specifically. Because the bottom wall 143 extends toward the interior 18 of the air handling unit 10, this helps prevent transfer of the thermal energy into the interior 18 of the unit 10.

The left wall 144 also includes a thermal break 146. The thermal break 146 extends in the left wall 144 from the top wall 141 to approximately halfway between the top and bottom walls 141 and 143. The thermal break 146 extends entirely along the length of the frame element 25 and as such, is a thermal discontinuity limiting the transfer of thermal energy through the frame element 25 and from the top wall 141 to the metal portion of the left wall 144 specifically. Because the left wall 144 extends toward the interior 18 of the unit 10, this helps prevent transfer of the thermal energy into the interior 18 of the unit 10.

The thermal breaks 145 and 146 are constructed of a material or combination of materials which have material characteristics of durability, ruggedness, resiliency, thermal insulation, and which can withstand extremely high temperatures without altering these material characteristics and without deforming.

At the juncture of the bottom and left walls 143 and 144, two flanges 150 and 151 project outwardly away from the sidewall 140 of the frame element 25. The flanges 150 and 151 are thin and extend from the sidewall 140 to free ends. The flanges 150 and 151 extend along the entire length of the frame element 25. The flange 150 has an inner face 152 and an opposed outer face 153. Likewise, the flange 151 has an inner face 154 and an opposed outer face 154.

When the frame element 25 occupies the void 130, the top wall 141 of the frame element 25 faces the intermediate surface 101 of the insulation panel 20 and is slightly apart therefrom. The right wall 142 faces and is spaced slightly apart from the intermediate surface 121 of the insulation panel 20'. The bottom wall 143 faces and is spaced slightly apart from the proximal surface 122 of the insulation panel 20'. The left wall 144 faces and is spaced slightly apart from the proximal surface 102 of the insulation panel 20. The inner face 152 of the flange 150 faces and is spaced slightly apart from the inner surface 118 of the panel 20'. The inner face 154 of the flange 151 faces and is spaced slightly apart from the inner surface 98 of the panel 20. Air impermeable seals are formed between all of these components.

Between the top wall 141 of the frame element 25 and the intermediate surface 101 of the insulation panel 20, there are two gaskets 160. The gaskets 160 extend entirely along the length of the frame element 25. The gaskets 160 are constructed of a material or combination of materials which have material characteristics of durability, ruggedness, resiliency, thermal insulation, and which can withstand extremely high temperatures without altering these material characteristics and without deforming. One gasket 160 is proximate the right wall 142, and the other gasket 160 is proximate the left wall 144. The gaskets 160 each define an air-impermeable seal. Between the two gaskets 160, self-tapping screws 161 couple the panel 20 to the frame element 25. Only one such screw 161 is visible in FIG. 9, but there are many self-tapping screws 161 along the length of the frame element 25. The screws 161 pass through the skin 90 at the inner surface 98 of the panel 20, with the head of the screw 161 disposed in the interior 91 and the shank of the screw 161 through the top wall 141 and into the frame element 25.

Between the right wall 142 and the intermediate surface 121 of the insulation panel 20', there are two gaskets 160. These gaskets 160 also extend entirely along the length of the frame element 25. These gaskets 160 are constructed of a material or combination of materials which have material characteristics of durability, ruggedness, resiliency, thermal insulation, and which can withstand extremely high temperatures without a altering these material characteristics and without deforming. One gasket 160 is proximate the top wall 141, and the other gasket 160 is proximate the bottom wall 143. The gaskets 160 each define an air-impermeable seal. Between the two gaskets 160, self-tapping screws 161 couple the panel 20' to the frame element 25. Only one such screw 161 is visible in FIG. 9, but there are many self-tapping screws 161 along the length of the frame element 25. The screws 161 pass through the skin 110 at the inner surface 118 of the panel 20', with the head of the screw 161 disposed in the interior 111 and the shank of the screw 161 through the top wall 141 and into the frame element 25.

Between the bottom wall 143 and the proximal surface 122 of the insulation panel 20', there is a sealant 162. The sealant 162 is a caulking material applied during assembly of the unit 10. The sealant 162 extends broadly across the outer face of the bottom wall 143 substantially entirely from the right wall 142 to the left wall 144, covering both the metal portion of the bottom wall 143 and the thermal break 145. The sealant 162 further extends along the entire length of the frame element 25. The sealant 162 is an air-impermeable seal.

A thermal break 163 is also fit into a slot 168 in the proximal surface 122. The thermal break 163 has an H-shape; it includes a base 164 which is disposed in and fills the space between the bottom wall 143 and the proximal surface 122, a neck 165 which extends through the slot 168, and a cap 166 which projects laterally outward from the neck 165, terminating in upwardly-turned lips 167. The cap 166 of the thermal break 163 is in the interior 111 of the panel 20'. The thermal break 163 is constructed of a material or combination of materials which have material characteristics of durability, ruggedness, resiliency, thermal insulation, and which can withstand extremely high temperatures without altering these material characteristics and without deforming.

Between the left wall 144 and the proximal surface 102 of the insulation panel 20, there is a sealant 162. The sealant 162 is a caulking material applied during assembly of the unit 10. The sealant 162 extends broadly across the outer face of the left wall 144 substantially entirely from the top wall 141 to the bottom wall 143, covering both the metal portion of the left wall 144 and the thermal break 146. The sealant 162 further extends along the entire length of the frame element 25. The sealant 162 is an air-impermeable seal.

Another thermal break 163 is fit into a slot 169 in the proximal surface 122. The thermal break 163 is identical to the other; it includes a base 164 which is disposed in and fills the space between the left wall 144 and the proximal surface 102, a neck 165 which extends through the slot 169, and a cap 166 which projects laterally outward from the neck 165, terminating in upwardly-turned lips 167. The cap 166 of this thermal break 163 is in the interior 91 of the panel 20. The thermal break 163 is constructed of a material or combination of materials which have material characteristics of durability, ruggedness, resiliency, thermal insulation, and which can withstand extremely high temperatures without altering these material characteristics and without deforming.

Between the inner face 152 of the flange 150 and the inner surface 118 of the panel 20' is a gasket 160, proximate to the bottom wall 143. This gasket 160 defines an air-impermeable seal. This gasket 160 extends entirely along the length of the flange 150 and is constructed of a material or combination of materials which have material characteristics of durability, ruggedness, resiliency, thermal insulation, and which can withstand extremely high temperatures without altering these material characteristics and without deforming. Proximate to the free end of the flange 150, a self-tapping screw 161 couples the panel 20' to the frame element 25. Only one such screw 161 is visible in FIG. 9, but there are many self-tapping screws 161 along the length of the flange 150. The screws 161 pass through the skin 110 at the inner surface 118 of the panel 20'. The head of the screw 161 is disposed in the interior 18 of the air handling unit 10 against the outer face 153 of the flange 150, and the shank of the screw 161 passes through the inner surface 118 of the panel 20' and into the interior 111 of the panel 20'.

Between the inner face 154 of the flange 151 and the inner surface 98 of the panel 20 is a gasket 160, proximate to the left wall 144. This gasket 160 defines an air-impermeable seal. This gasket 160 extends entirely along the length of the flange 151 and is constructed of a material or combination of materials which have material characteristics of durability, ruggedness, resiliency, thermal insulation, and which can withstand extremely high temperatures without altering these material characteristics and without deforming. Proximate to the free end of the flange 151, a self-tapping screw 161 couples the panel 20 to the frame element 25. Only one such screw 161 is visible in FIG. 9, but there are many self-tapping screws 161 along the length of the flange 151. The screws 161 pass through the skin 90 at the inner surface 98 of the panel 20. The head of the screw 161 is disposed in the interior 18 of the air handling unit 10 against the outer face 155 of the flange 151, and the shank of the screw 161 passes through the inner surface 98 of the panel 20 and into the interior 91 of the panel 20.

Finally, between the intermediate surface 101 of the panel 20 and the distal surface 120 of the panel 20', in the seam 133, is a sealant 162. This sealant 162 defines an air-impermeable seal. The sealant 162 extends broadly across the distal surface 120 entirely from intermediate surface 121 to the outer surface 117. Therefore, the sealant 162 extends across the entire insulation seam 133.

In this way, the insulation panels 20 and 20' are secured to the frame element 25 and form air-impermeable seals with each other and with the frame element 25. By doing so, they mitigate the transfer of thermal energy from outside of the air handling unit 10 to the interiors 17 and 18 of the unit 10.

Figure 10:
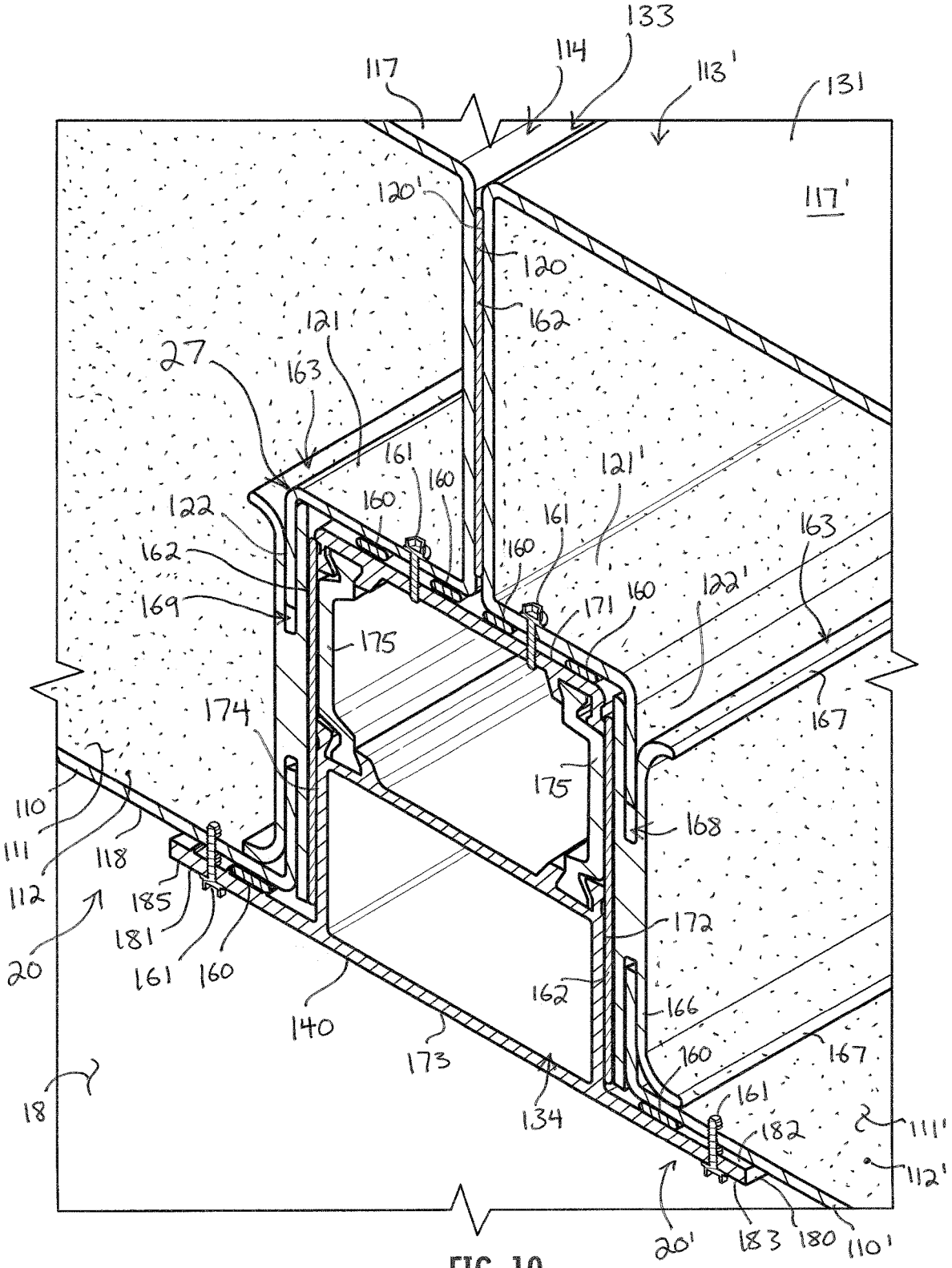
FIG. 10 is a section view taken along the line 10-10 of FIG. 2 showing insulation panels meeting and confronting a frame element at another juncture.

FIG. 10 is a section view taken along the line 8-8 in FIG. 2. While FIGS. 8 and 9 illustrate a juncture 85 where two insulation panels 20 confronted a fame element 27 at a corner 22 of the unit 10, FIG. 10 shows a juncture 85 where two insulation panels 20 abut each other and confront a frame element 27 at a planar section of the unit 10, such as where two side-by-side coplanar insulation panels 20 meet. These two insulation panels 20 are registered in alignment with each other. Both insulation panels 20 are arranged horizontally in FIG. 10, though this description is equally applicable where both insulation panels 20 are arranged vertically. Laying multiple panels 20 out in this abutting, registered fashion allows an air handling unit housing to be constructed with long, continuous, unbroken walls 23 and floors 24.

Because the two insulation panels 20 are identical to each other in all respects but for location, for clarity of the ensuing description, and with respect to FIG. 10 only, the insulation panel on the left of the drawing is identified with the reference character 20 and the insulation panel on the right is identified with the reference character 20'. Moreover, the structural elements and features of the insulation panel 20' on the right carry the prime ("'") designation to distinguish them from those of the panel 20 on the left. The description below then often refers only to only one of the panels 20 and 20' and one set of the reference characters—with or without the prime symbol—to avoid repeating reference characters both with and without the prime symbol. The reader will understand that the description applies equally to both panels 20 and 20'.

The insulation panel 20 in FIG. 10 is identical to the insulation panel 20' in FIGS. 8 and 9. Therefore, it is unnecessary to repeat a full description of the structural elements and features of the panel 20, and only a limited discussion is presented below, as the reader will understand that the panel 20 has all of the identical structural elements and features of the panel 20' from FIGS. 8 and 9 and that the prior description of the panel 20' from FIGS. 8 and 9 is applicable here. The insulation panel 20 has mirror symmetry, such that its ends 113 and 114 are identical, and the structural elements and features that are located at one end 113 are the same as those at the other end 114.

Therefore, as with the insulation panel 20' of FIGS. 8 and 9, the insulation panel 20 of FIG. 10 has an outer skin 110 fully bounding and encasing an interior 111 filled with insulation 112. The insulation panel 20 has opposed ends 113 and 114 and opposed sides 115 and 116, an outer surface 117 and opposed inner surface 118, and a thickness of preferably four inches. Each of the ends 113 and 114 has a stepped profile with a distal surface 120 adjacent to the outer surface 117 which extends from the outer surface 117 approximately two inches, or half the thickness of the panel 20. There, an intermediate surface 121 extends inboard from the distal surface 120 approximately two inches, is preferably normal to the distal surface 120, and is preferably parallel to the outer surface 117. The intermediate surface 121 terminates inwardly at a proximal surface 122. The proximal surface 122 turns, depending from the intermediate surface 121 approximately two inches, or half the thickness of the panel 20 to meet and form an inner corner 123 with the inner surface 118 of the panel 20. The proximal surface 122 is parallel to the distal surface 120 and is normal to the outer, inner, and intermediate surfaces 117, 118, and 121.

As shown in FIG. 10, the two insulation panels 20 and 20' confront each other in horizontal registration. The insulation panels 20 and 20' cooperate to define an open void 134 between the insulation panels 20 and 20' at their ends 114 and 114', respectively. The void 134 has an elongate, rectangular prismatic shape that extends along the full length of the ends 114 and 114'. The void 134 is sized and shaped to closely receive the frame element 27. The void 134 is inboard of both outer surfaces 97 and 117, recessed within the insulation panels 20 and 20', and is open on its bottom along the inner surfaces 118 and 118'.

The void 134 is open because it is bounded on all sides except at the opening along the inner surfaces 118 and 118'. When a frame element 27 is received within the void 134, the frame element 27 is recessed away from the common outer surface 131 of the unit 10, and the frame element 27 is sealed to the surrounding faces of the insulation panels 20 and 20'. The void 134, and the frame element 27 embedded therein, are therefore insulated from the environment outside the unit 10.

Similarly to the juncture 85 of FIGS. 8 and 9, the outer surfaces 97 and 97' in FIG. 10 cooperate to form the common outer surface 131 of the air handling unit 10 which is continuous across the entire unit 10 except at the insulation seams 133 formed between the insulation panels 20. These seams 133 are sealed, however, as described below.

When the insulation panels 20 and 20' are registered in horizontal alignment as in the arrangement of FIG. 10, the distal surfaces 100 and 100' face each other registration, coextensive to each other, spaced apart only slightly by the seam 133. The intermediate surfaces 101 and 101' are registered in coplanar alignment with each other and are, at their outer ends, just slightly apart in spaced relation from each other. The proximal surfaces 122 and 122' face each other but are set apart in spaced relation by a rectangular prismatic void 134 having a dimension of approximately two inches. The inner surfaces 118 and 118' are registered in coplanar alignment with each other and are, at their outer ends, also set apart in spaced relation by the void 134, or approximately two inches.

The frame element 27 occupies the void 134. As noted far above, the frame element 27 is similar to the frame element 25 but is not identical, since it joins to coplanar panels 20 and 20' at a horizontal juncture 86 rather than to transverse panels at a corner juncture 85. The frame element 27 is an elongate rectangular prismatic member. In the drawings of this embodiment, the frame element 27 has a generally square cross-section as illustrated in FIG. 10. The frame element 27 has a sidewall 170 formed of a combination of metal and plastic thermal breaks. The sidewall 170 includes a top wall 171, a right wall 172, a bottom wall 173, and a left wall 174. As above, these names are selected only to easily identify and refer to the walls shown in FIG. 10 and not to limit their description or scope in any way. Each of the walls has an inner face, directed into the frame element 27, and an opposed outer face, directed out of the frame element 27. These inner and outer faces are not labeled with reference characters because it should be clear from the drawings and the description where these faces are located.

The top wall 171 is preferably constructed from metal and extends entirely from the left wall 174 to the right wall 172. Similarly, the bottom wall 172 is preferably constructed from metal and extends entirely from the left wall 174 to the right wall 172.

The right wall 172, however, includes a thermal break 175. The thermal break 175 extends in the right wall 172 from the top wall 171 to approximately halfway between the top and bottom walls 171 and 173. The thermal break 175 extends entirely along the length of the frame element 27 and as such, is a thermal discontinuity limiting the transfer of thermal energy through the frame element 27 and from the top wall 171 to the metal portion of the right wall 172 specifically. Because the right wall 172 extends toward the interior 18 of the air handling unit 10, this helps prevent transfer of the thermal energy into the interior 18 of the unit 10.

The left wall 174 also includes a thermal break 176. The thermal break 176 extends in the left wall 174 from the top wall 171 to approximately halfway between the top and bottom walls 171 and 173. The thermal break 176 extends entirely along the length of the frame element 27 and as such, is a thermal discontinuity limiting the transfer of thermal energy through the frame element 27 and from the top wall 171 to the metal portion of the left wall 174 specifically. Because the left wall 174 extends toward the interior 18 of the unit 10, this helps prevent transfer of the thermal energy into the interiors 17 and 18 of the unit 10.

The thermal breaks 175 and 176 are constructed of a material or combination of materials which have material characteristics of durability, ruggedness, resiliency, thermal insulation, and which can withstand extremely high temperatures without altering these material characteristics and without deforming.

A flange 180 projects outwardly away from the sidewall 170 of the frame element 27 at the corner formed by the right and bottom walls 172 and 173. Similarly, a flange 181 projects outwardly away from the sidewall 170 of the frame element 27 at the corner formed by the left and bottom walls 174 and 173. The flanges 180 and 181 are coplanar to the bottom wall 173 and are extensions of that wall 173 terminating at free ends beyond the sidewall 170.

The flanges 180 and 181 are thin, and they extend along the entire length of the frame element 27. The flange 180 has an inner face 182 and an opposed outer face 183. Likewise, the flange 181 has an inner face 184 and an opposed outer face 184.

When the frame element 27 occupies the void 134, the top wall 171 of the frame element 27 faces the intermediate surfaces 121 and 121' of the panels 20 and 20' and is slightly apart from each. The right wall 172 faces and is spaced slightly apart from the proximal surface 122' of the panel 20'. The bottom wall 173 is exposed to the open interior 18 of the air handling unit 10. The left wall 174 faces and is spaced slightly apart from the proximal surface 122 of the insulation panel 20. The inner face 182 of the flange 180 faces and is spaced slightly apart from the inner surface 118' of the panel 20'. The inner face 184 of the flange 181 faces and is spaced slightly apart from the inner surface 98 of the panel 20. Air impermeable seals are formed between all of these components.

Between the top wall 171 of the frame element 27 and the intermediate surface 121 of the insulation panel 20, and also between the top wall 171 of the frame element 27 and the intermediate surface 121' of the panel 20', there are two gaskets 160. The gaskets 160 extend entirely along the length of the frame element 27. The gaskets 160 are constructed of a material or combination of materials which have material characteristics of durability, ruggedness, resiliency, thermal insulation, and which can withstand extremely high temperatures without altering these material characteristics and without deforming.

One gasket 160 is proximate the right wall 172, another is proximate the left wall 174, and there two more located therebetween. The gaskets 160 each define an air-impermeable seal. Between the right-most gasket 160 and the gasket 160 to its left, and between the left-most gasket 160 and the gasket 160 to its right, self-tapping screws 161 couple the panel 20 to the frame element 27. Only two such screws 161 are visible in FIG. 10, but there are many self-tapping screws 161 along the length of the frame element 27. The screws 161 pass through the skins 110 and 110' at the inner surfaces 118 and 118' of the panels 20 and 20', with the heads of the screws 161 disposed in the interiors 111 and 111' and the shanks of the screws 161 through the top wall 171 and into the frame element 27.

Between the right wall 172 and the proximal surface 122', there is a sealant 162. The sealant 162 is a caulking material applied during assembly of the unit 10. The sealant 162 extends broadly across the outer face of the right wall 172 substantially entirely from the top wall 171 to the bottom wall 173, covering both the metal portion of the right wall 173 and the thermal break 175. The sealant 162 further extends along the entire length of the frame element 27. The sealant 162 is an air-impermeable seal.

A thermal break 163 is also fit into a slot 168' in the proximal surface 122' of the panel 20'. The thermal break 163 has an H-shape; it includes a base 164 which is disposed in and fills the space between the right wall 172 and the proximal surface 122', a neck 165 which extends through the slot 168', and a cap 166 which projects laterally outward from the neck 165, terminating in upwardly-turned lips 167. The cap 166 of the thermal break 163 is in the interior 111' of the panel 20'. The thermal break 163 is constructed of a material or combination of materials which have material characteristics of durability, ruggedness, resiliency, thermal insulation, and which can withstand extremely high temperatures without altering these material characteristics and without deforming.

Between the left wall 174 and the proximal surface 122 of the insulation panel 20, there is a sealant 162. The sealant 162 is a caulking material applied during assembly of the unit 10. The sealant 162 extends broadly across the outer face of the left wall 174 substantially entirely from the top wall 171 to the bottom wall 173, covering both the metal portion of the left wall 174 and the thermal break 176. The sealant 162 further extends along the entire length of the frame element 27. The sealant 162 is an air-impermeable seal.

A thermal break 163 is also fit into a slot 168 in the proximal surface 122 of the panel 20. The thermal break 163 has an H-shape; it includes a base 164 which is disposed in and fills the space between the left wall 174 and the proximal surface 122, a neck 165 which extends through the slot 168, and a cap 166 which projects laterally outward from the neck 165, terminating in upwardly-turned lips 167. The cap 166 of the thermal break 163 is in the interior 111 of the panel 20. The thermal break 163 is constructed of a material or combination of materials which have material characteristics of durability, ruggedness, resiliency, thermal insulation, and which can withstand extremely high temperatures without altering these material characteristics and without deforming.

Between the inner face 182 of the flange 180 and the inner surface 118' of the panel 20' is a gasket 160, proximate to the bottom wall 173. This gasket 160 defines an air-impermeable seal. This gasket 160 extends entirely along the length of the flange 180 and is constructed of a material or combination of materials which have material characteristics of durability, ruggedness, resiliency, thermal insulation, and which can withstand extremely high temperatures without altering these material characteristics and without deforming. Proximate to the free end of the flange 180, a self-tapping screw 161 couples the panel 20' to the frame element 27. Only one such screw 161 is visible in FIG. 10, but there are many self-tapping screws 161 along the length of the flange 180. The screws 161 pass through the skin 110' at the inner surface 118' of the panel 20'. The head of the screw 161 is disposed in the interior 18 of the air handling unit 10 against the outer face 183 of the flange 180, and the shank of the screw 161 passes through the inner surface 118' of the panel 20' and into the interior 111 of the panel 20'.

Between the inner face 184 of the flange 181 and the inner surface 98 of the panel 20 is a gasket 160, proximate to the left wall 174. This gasket 160 defines an air-impermeable seal. This gasket 160 extends entirely along the length of the flange 181 and is constructed of a material or combination of materials which have material characteristics of durability, ruggedness, resiliency, thermal insulation, and which can withstand extremely high temperatures without altering these material characteristics and without deforming. Proximate to the free end of the flange 181, a self-tapping screw 161 couples the panel 20 to the frame element 27. Only one such screw 161 is visible in FIG. 10, but there are many self-tapping screws 161 along the length of the flange 181. The screws 161 pass through the skin 90 at the inner surface 98 of the panel 20. The head of the screw 161 is disposed in the interior 18 of the air handling unit 10 against the outer face 155 of the flange 181, and the shank of the screw 161 passes through the inner surface 98 of the panel 20 and into the interior 91 of the panel 20.

Finally, between the distal surface 120 of the panel 20 and the distal surface 120' of the panel 20', in the seam 133, is a sealant 162. This sealant 162 defines an air-impermeable seal. The sealant 162 extends broadly across the distal surfaces 120 and 120' entirely from the outer surfaces 117 and 117' to the intermediate surfaces 121 and 122', respectively.

In this way, the insulation panels 20 and 20' are secured to the frame element 27 and form air-impermeable seals with each other and with the frame element 27. By doing so, they mitigate the transfer of thermal energy from outside of the unit to the interiors 17 and 18 of the unit 10.

Assembling the air handling unit 10 with the insulation panels 20 on the frame elements 25 and 27 described herein enables the frame elements 25 and 27 to be recessed well below the common outer surface 131 of the air handling unit 10, thereby insulating the frame elements 25 and 27 from thermal transfer. Moreover, the gaskets 160 and sealants 162 prevent transmission of air between the environment and the interior 17 and 18. Finally, the long assemblies of frame elements 25 enables construction of a continuous, single-compartment air handling unit 10, improving its operational efficacy and efficiency.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. An air handling unit comprising:

a frame element;

first and second insulation panels which confront the frame element at a juncture;

the first insulation panel includes a first distal surface, a first proximal surface, a first intermediate surface extending between the first distal and proximal surfaces, and a first inner surface;

the second insulation panel includes a second distal surface, a second proximal surface, a second intermediate surface extending between the second distal and proximal surfaces, and a second inner surface; and at the juncture:

the second distal surface faces the first intermediate surface at an insulation seam;

the second proximal surface faces in spaced relation the first intermediate surface and the second intermediate surface faces in spaced relation the first proximal surface, thereby defining a closed void defined between the first intermediate surface, the first proximal surface, the second intermediate surface, and the second proximal surface; and the frame element occupies the closed void;

wherein:

a first air-impermeable seal is in the insulation seam;

second air-impermeable seals are between the frame element and the first and second intermediate surfaces, respectively, and between the frame element and the first and second inner surfaces, respectively; and third air-impermeable seals are between the frame element and the first and second proximal surfaces, respectively.

2. The air handling unit of claim 1, wherein:

the first distal surface is parallel to the first proximal surface, and the second distal surface is parallel to the second proximal surface;

the first intermediate surface is normal to the first distal surface and to the first proximal surface, and the second intermediate surface is normal to the second distal surface and to the second proximal surface; and the first inner surface is normal to the first distal surface and to the first proximal surface, and the second inner surface is normal to the second distal surface and to the second proximal surface.

3. The air handling unit of claim 1, wherein:

the first and second insulation panels are normal to each other; and at the juncture, the first insulation panel overlaps the second insulation panel.

4. The air handling unit of claim 1, wherein:

the first air-impermeable seal in the insulation seam is a sealant extending along the insulation seam;

the second air-impermeable seal between the frame element and the first intermediate surface comprises two gaskets each extending along a length of the frame element;

the second air-impermeable seal between the frame element and the second intermediate surface comprises another two gaskets each extending along the length of the frame element;

the second air-impermeable seal between the frame element and the first inner surface comprises another gasket extending along the length of the frame element;

the second air-impermeable seal between the frame element and the second inner surface comprises yet another gasket extending along the length of the frame element;

the third air-impermeable seal between the frame element and the first proximal surface is another sealant extending along a length of the frame element; and the third air-impermeable seal between the frame element and the second proximal surface is yet another sealant extending along the length of the frame element.

5. An air handling unit comprising:

a frame element;

first and second insulation panels which confront the frame element at a juncture;

the first insulation panel includes a first distal surface, a first proximal surface, a first intermediate surface extending between the first distal and proximal surfaces, and a first inner surface;

the second insulation panel includes a second distal surface, a second proximal surface, a second intermediate surface extending between the second distal and proximal surfaces, and a second inner surface; and at the juncture:

the first distal surface faces the second distal surface at an insulation seam;

the first intermediate surface is registered in alignment with the second intermediate surface;

the first proximal surface faces the second proximal surface in spaced relation, thereby defining an open void between the first intermediate surface, the first proximal surface, the second intermediate surface, and the second proximal surface; and the frame element occupies the open void;

wherein:

a first air-impermeable seal is in the insulation seam;

second air-impermeable seals are between the frame element and the first and second intermediate surfaces, respectively, and between the frame element and the first second inner surfaces, respectively; and third air-impermeable seals are between the frame element and the first and second proximal surfaces, respectively.

6. The air handling unit of claim 5, wherein:

the first distal surface is parallel to the first proximal surface, and the second distal surface is parallel to the second proximal surface;

the first intermediate surface is normal to the first distal surface and to the first proximal surface, and the second intermediate surface is normal to the second distal surface and to the second proximal surface; and the first inner surface is normal to the first distal surface and to the first proximal surface, and the second inner surface is normal to the second distal surface and to the second proximal surface.

7. The air handling unit of claim 5, wherein:

the first and second insulation panels are registered in alignment with each other; and at the juncture, the first insulation panel abuts the second insulation panel.

8. The air handling unit of claim 5, wherein:

the first air-impermeable seal in the insulation seam is a sealant extending along the insulation seam;

the second air-impermeable seal between the frame element and the first intermediate surface comprises two gaskets each extending along a length of the frame element;

the second air-impermeable seal between the frame element and the second intermediate surface comprises another two gaskets each extending along the length of the frame element;

the second air-impermeable seal between the frame element and the first inner surface comprises another gasket extending along a length of the frame element;

the second air-impermeable seal between the frame element and the second inner surface comprises yet another gasket extending along the length of the frame element;

the third air-impermeable seal between the frame element and the first proximal surface is another sealant extending a length of the frame element; and the third air-impermeable seal between the frame element and the second proximal surface is yet another sealant extending along the length of the frame element.

9. An air handling unit comprising:

a housing constructed from a plurality of insulation panels embedded with frame elements;

the frame elements include at least a first frame element and a second frame element joined together by an inline connector;

each insulation panel includes an outer surface and an opposed inner surface, wherein the insulation panels all cooperate to form (1) a common outer surface of the air handling unit comprised of the outer surfaces of the insulation panels and (2) a common inner surface of the air handling unit comprised of the inner surfaces of the insulation panels;

wherein the common inner surface bounds and defines an interior space of the air handling unit; and the frame elements are all inboard of the common outer surface, recessed and embedded within the insulation panels.

10. The air handling unit of claim 9, wherein the inline connector comprises:

a middle section;

a first mating portion extending from the middle section in a first direction to a first end;

a second mating portion extending from the middle section in a second direction, opposite the first direction, to a second end;

the first mating portion comprising a first major plug and a first minor plug, wherein the first major and minor plugs are configured to fit into sockets in the frame elements;

the second mating portion comprising a second major plug and a second minor plug, wherein the second major and minor plugs are configured to fit into the sockets in the frame elements; and the middle section includes a generally rectangular prismatic body having a dimension larger than the first and second mating portions, and two flanges projecting outwardly away from the body.

11. The air handling unit of claim 10, wherein:

the first major plug and the first minor plug are separated by a slender first gap; and the second major plug and the second minor plug are separated by a slender second gap.

12. The air handling unit of claim 10, wherein the flanges are proximate the first and second minor plugs.

13. The air handling unit of claim 9, wherein:

the insulation panels include at least a first insulation panel and a second insulation panel confronting one of the frame elements at a juncture;

the first insulation panel includes a first distal surface, a first proximal surface, a first intermediate surface extending between the first distal and proximal surfaces, and a first inner surface;

the second insulation panel includes a second distal surface, a second proximal surface, a second intermediate surface extending between the second distal and proximal surfaces, and a second inner surface; and at the juncture:

the second distal surface faces the first intermediate surface at an insulation seam;

the second proximal surface faces in spaced relation the first intermediate surface and the second intermediate surface faces in spaced relation the first proximal surface, thereby defining a closed void between the first intermediate surface, the first proximal surface, the second intermediate surface, and the second proximal surface; and at least one of the first and second frame elements occupies the closed void.

14. The air handling unit of claim 13, wherein:

the first distal surface is parallel to the first proximal surface, and the second distal surface is parallel to the second proximal surface;

the first intermediate surface is normal to the first distal surface and to the first proximal surface, and the second intermediate surface is normal to the second distal surface and to the second proximal surface; and the first inner surface is normal to the first distal surface and to the first proximal surface, and the second inner surface is normal to the second distal surface and to the second proximal surface.

15. The air handling unit of claim 13, wherein:

a first air-impermeable seal is in the insulation seam;

second air-impermeable seals are between the frame element and the first and second intermediate surfaces, respectively, and between the frame element and the first and second inner surfaces, respectively; and third air-impermeable seals are between the frame element and the first and second proximal surfaces, respectively.

16. The air handling unit of claim 15, wherein:

the first air-impermeable seal in the insulation seam is a sealant extending along the insulation seam;

the second air-impermeable seal between the frame element and the first intermediate surface comprises two gaskets each extending along a length of the frame element;

the second air-impermeable seal between the frame element and the second intermediate surface comprises another two gaskets each extending along the length of the frame element;

the second air-impermeable seal between the frame element and the first inner surface comprises another gasket extending along the length of the frame element;

the second air-impermeable seal between the frame element and the second inner surface comprises yet another gasket extending along the length of the frame element;

the third air-impermeable seal between the frame element and the first proximal surface is another sealant extending along a length of the frame element; and the third air-impermeable seal between the frame element and the second proximal surface is yet another sealant extending along the length of the frame element.

17. The air handling unit of claim 9, wherein:

the insulation panels include at least a first insulation panel and a second insulation panel confronting one of the frame elements at a juncture;

the first insulation panel includes a first distal surface, a first proximal surface, a first intermediate surface extending between the first distal and proximal surfaces, and a first inner surface;

the second insulation panel includes a second distal surface, a second proximal surface, a second intermediate surface extending between the second distal and proximal surfaces, and a second inner surface; and at the juncture:

the first distal surface faces the second distal surface at an insulation seam;

the first intermediate surface is registered in alignment with the second intermediate surface;

the first proximal surface faces the second proximal surface in spaced relation, thereby defining an open void between the first intermediate surface, the first proximal surface, the second intermediate surface, and the second proximal surface; and at least one of the first and second frame elements occupies the open void.

18. The air handling unit of claim 17, wherein:

the first distal surface is parallel to the first proximal surface, and the second distal surface is parallel to the second proximal surface;

the first intermediate surface is normal to the first distal surface and to the first proximal surface, and the second intermediate surface is normal to the second distal surface and to the second proximal surface; and the first inner surface is normal to the first distal surface and to the first proximal surface, and the second inner surface is normal to the second distal surface and to the second proximal surface.

19. The air handling unit of claim 17, wherein:

a first air-impermeable seal is in the insulation seam;

second air-impermeable seals are between the frame element and the first and second intermediate surfaces, respectively, and between the frame element and the first second inner surfaces, respectively; and third air-impermeable seals are between the frame element and the first and second proximal surfaces, respectively.

20. The air handling unit of claim 19, wherein:

the first air-impermeable seal in the insulation seam is a sealant extending along the insulation seam;

the second air-impermeable seal between the frame element and the first intermediate surface comprises two gaskets each extending along a length of the frame element;

the second air-impermeable seal between the frame element and the second intermediate surface comprises another two gaskets each extending along the length of the frame element;

the second air-impermeable seal between the frame element and the first inner surface comprises another gasket extending along a length of the frame element;

the second air-impermeable seal between the frame element and the second inner surface comprises yet another gasket extending along the length of the frame element;

the third air-impermeable seal between the frame element and the first proximal surface is another sealant extending a length of the frame element; and the third air-impermeable seal between the frame element and the second proximal surface is yet another sealant extending along the length of the frame element.

* * * * *